US006923556B1

(12) United States Patent
Baker, III

(10) Patent No.: US 6,923,556 B1
(45) Date of Patent: Aug. 2, 2005

(54) ILLUMINATED ORNAMENTAL APPARATUS

(76) Inventor: Fred A. Baker, III, 2816 Rocky Point Rd., Bremerton, WA (US) 98312

( * ) Notice: Subject to any disclaimer, the term of this patent is extended or adjusted under 35 U.S.C. 154(b) by 37 days.

(21) Appl. No.: 10/428,381

(22) Filed: May 5, 2003

(51) Int. Cl.[7] ..... F21V 21/00
(52) U.S. Cl. ..... 362/249; 362/252; 362/267; 362/806
(58) Field of Search ..... 362/565, 249, 362/125, 154, 156, 227, 362, 806, 252, 367

(56) References Cited

U.S. PATENT DOCUMENTS 3,737,647 A 6/1973 Gomi
D278,420 S 4/1985 Thompson
5,292,003 A * 3/1994 Baghdassarian ..... 206/575
5,558,422 A 9/1996 Sanford
6,017,132 A 1/2000 Miller et al.
6,020,823 A 2/2000 DeCicco
6,183,100 B1 * 2/2001 Suckow et al. ..... 362/35
6,669,021 B1 * 12/2003 Spielman ..... 206/457

* cited by examiner

*Primary Examiner*—Sandra O'Shea
*Assistant Examiner*—Guiyoung Lee

(57) ABSTRACT

An illuminated ornamental apparatus includes an outer housing having a top wall, a bottom wall, and a peripheral wall that extends between and is attached to the top and bottom walls. The outer housing comprises a substantially transparent material. An inner housing is positioned within the outer housing. The inner housing has a plurality of apertures therein. Each of a plurality of lights is mounted in one of the apertures such that each of the lights is directed away from the inner housing. A power supply is electrically coupled to the lights.

5 Claims, 4 Drawing Sheets

ILLUMINATED ORNAMENTAL APPARATUS

BACKGROUND OF THE INVENTION

Field of the Invention

The present invention relates to ornamental devices and more particularly pertains to a new ornamental device for which resembles an illuminated gift box.

SUMMARY OF THE INVENTION

The present invention generally comprises an outer housing having a top wall, a bottom wall, and a peripheral wall that extends between and is attached to the top and bottom walls. The outer housing comprises a substantially transparent material. An inner housing is positioned within the outer housing. The inner housing has a plurality of apertures therein. Each of a plurality of lights is mounted in one of the apertures such that each of the lights is directed away from the inner housing. A power supply is electrically coupled to the lights.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
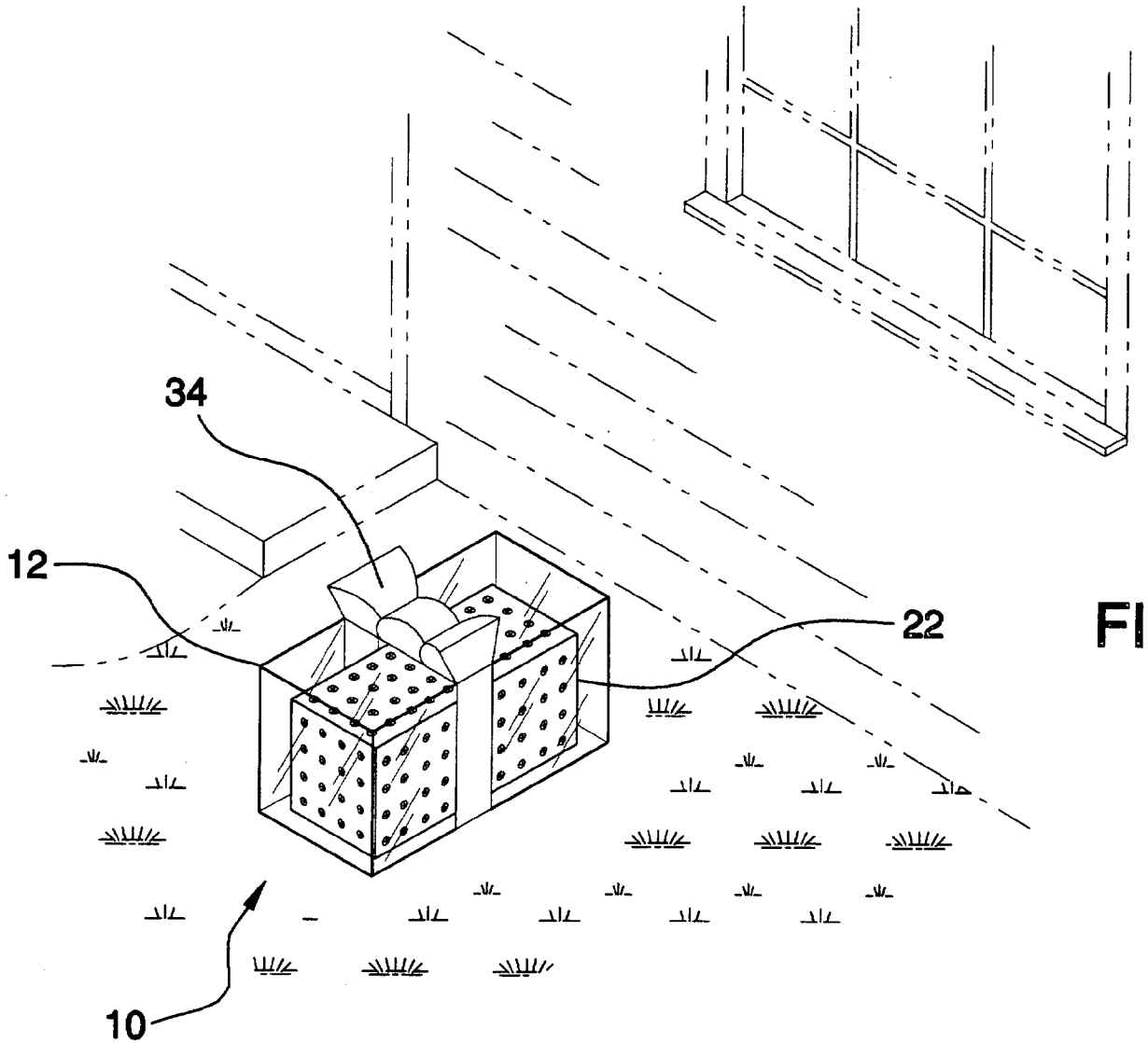
FIG. 1 is a schematic perspective view of an illuminated ornamental apparatus according to the present invention.
Figure 2:
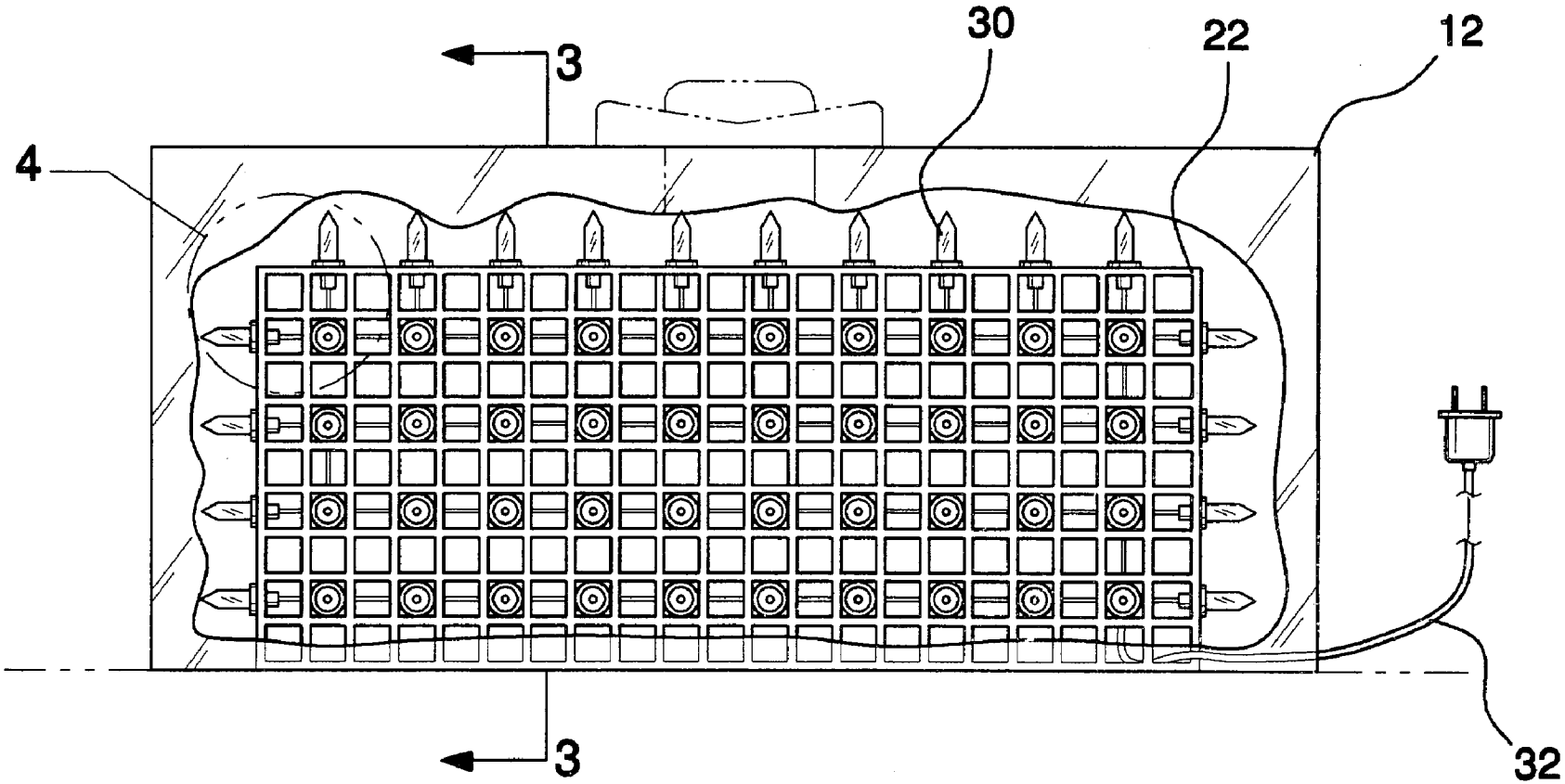
FIG. 2 is a schematic broken side view of the present invention.
Figure 3:
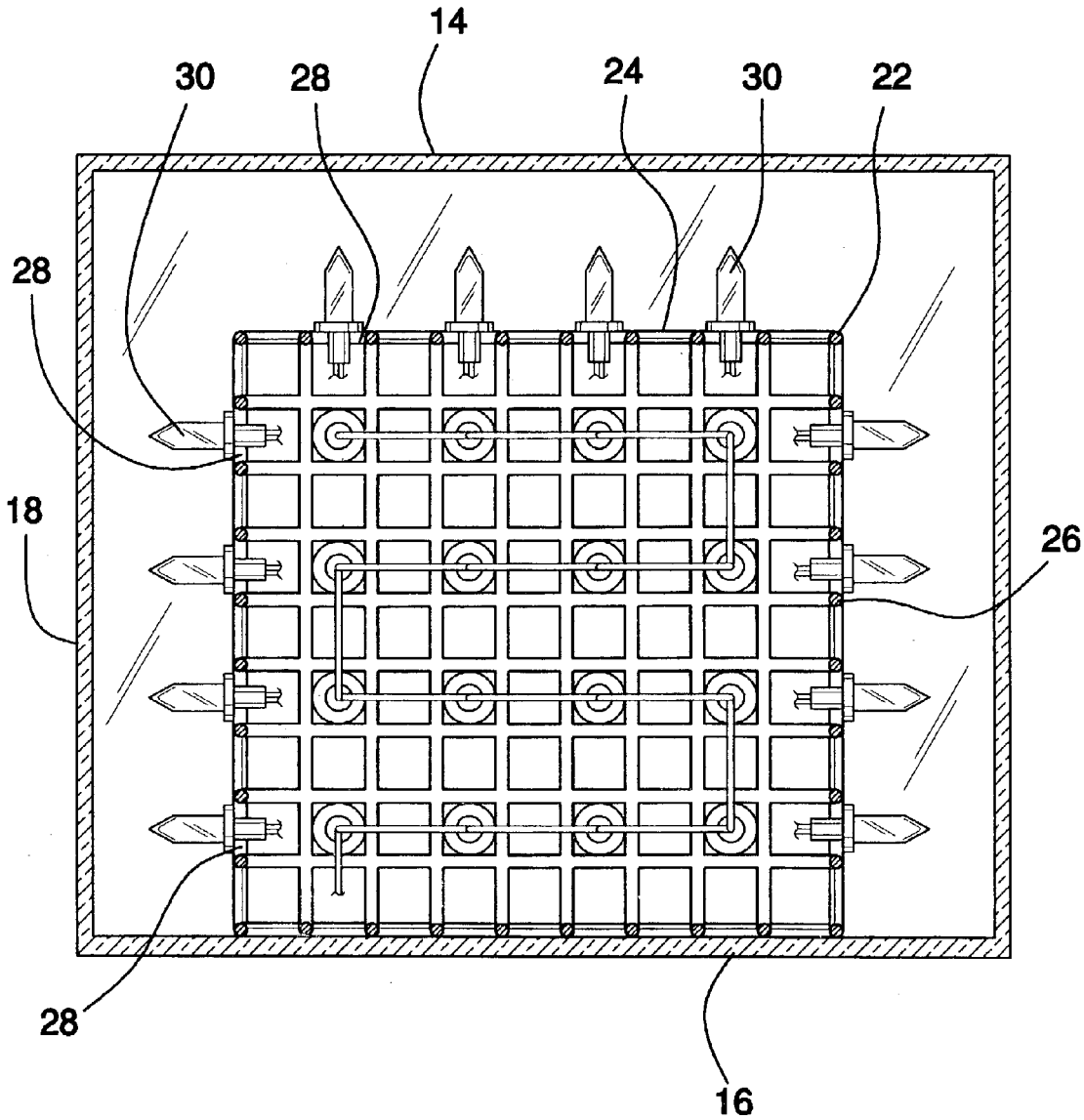
FIG. 3 is a schematic cross-sectional view taken along line 3—3 of FIG. 2 of the present invention.
Figure 4:
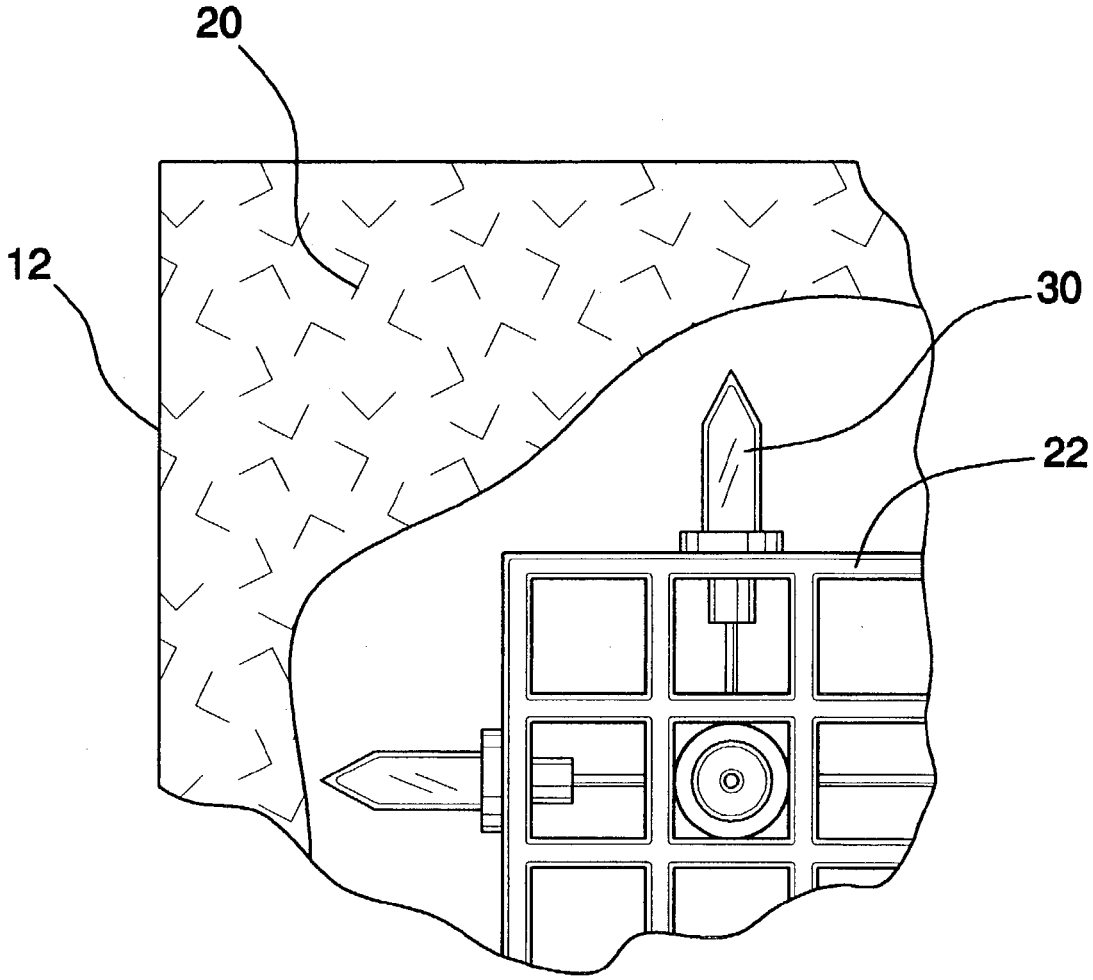
FIG. 4 is a schematic exploded view of area 4 of FIG. 2 of the present invention.

With reference now to the drawings, and in particular to FIGS. 1 through 4 thereof, a new ornamental device embodying the principles and concepts of the present invention and generally designated by the reference numeral 10 will be described.

As best illustrated in FIGS. 1 through 4, the illuminated ornamental apparatus 10 generally comprises an outer housing 12 having a top wall 14, a bottom wall 16, and a peripheral wall 18 extending between and attached to the top 14 and bottom 16 walls. The outer housing 12 comprises a substantially transparent material. Preferably, the transparent material has markings 20 thereon which resemble cracked ice. The markings 20 may be etched into the transparent material that is preferably a plastic material or the material may have internal cracks. The top wall 14 and the bottom wall 16 each preferably have a generally rectangular shape.

An inner housing 22 is positioned within the outer housing 12. The inner housing 22 includes an upper wall 24 and a perimeter side wall 26 that is attached to and extends downward from the upper wall 24. The upper wall 24 and the perimeter side wall 26 each have a plurality of apertures 28 therein. The inner housing 22 may be defined by a cage structure comprising metallic wiring.

Each of a plurality of lights 30 is mounted in one of the apertures 28 such that each of the lights 30 is directed away from the inner housing 22. Each of the lights 30 is connected in a series such that a string of lights is defined. The lights 30 may be adapted for turning on and off in a series or for a steady glow as is found in conventional strings of ornamental lights. A power supply 32 is electrically coupled to the lights. The power supply 32 preferably comprises an electrical cord extending through the outer housing 12. Optionally, an actuator, not shown, may be operationally coupled to the power supply.

It is preferred that a rigid bow 34 is attached to an outer surface of the outer housing 12. The rigid bow 34 comprises a plastic material and causes the outer housing 12 to resemble a gift.

In use, the lights 30 are turned on so that the outer housing 12 is illuminated to resemble an illuminated gift. The device 10 is positionable either outside or inside to provide a lighted and festive ornament.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An illuminated ornamental device comprising:

an outer housing having a top wall, a bottom wall, and a peripheral wall extending between and being attached to said top and bottom walls, said outer housing comprising a substantially transparent material;

an inner housing being positioned within said outer housing, said inner housing including an upper wall and a perimeter side wall being attached to and extending downward from said upper wall, said upper wall and said perimeter side wall each having a plurality of apertures therein;

a plurality of lights, each of said lights being mounted in one of said apertures such that said lights are directed upwardly and outwardly away from said inner housing; and a power supply being electrically coupled to said lights.

2. The illuminated ornamental device as in claim 1, wherein said transparent material has markings thereon, said markings resembling cracked ice.

3. The illuminated ornamental device as in claim 1, wherein said top wall and said bottom wall each have a generally rectangular shape.

4. The illuminated ornamental device as in claim 1, further including a rigid bow being attached to an outer surface of said outer housing, said rigid bow comprising a plastic material.

5. An illuminated device comprising:

an outer housing having a top wall, a bottom wall, and a peripheral wall extending between and being attached to said top and bottom walls, said outer housing comprising a substantially transparent material, said transparent material having markings thereon, said markings resembling cracked ice, said top wall and said bottom wall each having a generally rectangular shape;

an inner housing being positioned within said outer housing, said inner housing including an upper wall and a perimeter side wall being attached to and extending downward from said upper wall, said upper wall and said perimeter side wall each having a plurality of apertures therein;

a plurality of lights, each of said lights being mounted in one of said apertures, said lights being directly upwardly from said upper wall and outwardly from said perimeter side wall, each of said apertures having at least one of said lights mounted therein, each of said lights being connected in a series such that a string of lights is defined;

a power supply being electrically coupled to said lights, said power supply comprising an electrical cord extending through said outer housing; and a rigid bow being attached to an outer surface of said outer housing, said rigid bow comprising a plastic material.

* * * * *